US011717839B2

(12) United States Patent
Baldwin et al.

(10) Patent No.: US 11,717,839 B2
(45) Date of Patent: Aug. 8, 2023

(54) NOZZLE CONFIGURATIONS TO CREATE A VORTEX OF FIRE SUPPRESSION AGENT

(71) Applicant: Kidde Technologies, Inc., Wilson, NC (US)

(72) Inventors: Eli Baldwin, Knightdale, NC (US); Mark P. Fazzio, Wilson, NC (US); Terry Simpson, Wake Forest, NC (US); Adam Chattaway, Windsor (GB); Qing Edda Liu, Wake Forest, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 237 days.

(21) Appl. No.: 17/104,105

(22) Filed: Nov. 25, 2020

(65) Prior Publication Data

US 2022/0161279 A1 May 26, 2022

(51) Int. Cl.

| | |
|---|---|
| ***A62C 3/08*** | (2006.01) |
| ***B05B 1/34*** | (2006.01) |
| ***B05B 1/26*** | (2006.01) |

(52) U.S. Cl.

CPC ..... *B05B 1/3405* (2013.01); *A62C 3/08* (2013.01); *B05B 1/26* (2013.01)

(58) Field of Classification Search

CPC ..... A62C 3/08; B05B 1/26; B05B 1/3405

See application file for complete search history.

(56) References Cited

U.S. PATENT DOCUMENTS

| | | | | | |
|---|---|---|---|---|---|
| 2,452,348 | A * | 10/1948 | Beach | A62C 99/009 | 285/915 |
| 3,645,338 | A * | 2/1972 | Livingston | A62C 35/605 | 169/42 |
| 4,643,260 | A * | 2/1987 | Miller | A62C 3/06 | 169/68 |
| 5,211,246 | A * | 5/1993 | Miller | A62D 1/0057 | 169/10 |
| 7,066,274 | B2 * | 6/2006 | Lazzarini | A62C 3/08 | 239/54 |
| 9,421,406 | B2 * | 8/2016 | Seebaluck | A62C 35/68 | |
| 9,550,080 | B2 * | 1/2017 | Stehman | A62C 5/006 | |
| 10,240,243 | B2 * | 3/2019 | O'Coin | C25B 15/08 | |

(Continued)

FOREIGN PATENT DOCUMENTS

| | | | | |
|---|---|---|---|---|
| DE | 896600 C | * 11/1953 | | A62C 3/08 |
| DE | 896600 C | 11/1953 | | |

(Continued)

OTHER PUBLICATIONS

Extended European Search Report for EP Application No. 21209742.2, dated Apr. 13, 2022, pp. 1-8.

*Primary Examiner* — Joseph A Greenlund

(74) *Attorney, Agent, or Firm* — Cantor Colburn LLP

(57) ABSTRACT

A fire suppression system in an aircraft includes a first nozzle within a region to perform discharge of a fire suppression agent in a first direction within a region. The systems also includes a second nozzle within the region to perform discharge of the fire suppression agent in a second direction within the region. The discharge in the first direction by the first nozzle and the discharge in the second direction by the second nozzle generate and maintain a vortex of the fire suppression agent that occupies the region with rotational flow.

20 Claims, 7 Drawing Sheets

(56) References Cited

U.S. PATENT DOCUMENTS

| | | | | |
|---|---|---|---|---|
| 11,432,460 | B2 * | 9/2022 | Stoller | A01C 23/007 |
| 2004/0256118 | A1 * | 12/2004 | Dunster | A62C 31/02 169/54 |
| 2010/0218959 | A1 * | 9/2010 | Adiga | A62C 3/006 169/65 |
| 2015/0034340 | A1 * | 2/2015 | Ronpagel | F16L 58/1054 169/16 |
| 2015/0034342 | A1 * | 2/2015 | Seebaluck | A62C 3/08 169/61 |
| 2016/0263410 | A1 * | 9/2016 | Enk, Sr. | A62C 99/0036 |
| 2020/0094089 | A1 * | 3/2020 | Hagge | A62C 5/00 |
| 2020/0132416 | A1 * | 4/2020 | Townsend | F41G 5/18 |
| 2021/0370111 | A1 * | 12/2021 | Diaz | A62C 99/0063 |
| 2022/0161279 | A1 * | 5/2022 | Baldwin | A62C 99/0009 |
| 2022/0258185 | A1 * | 8/2022 | Gu | B81B 1/002 |
| 2022/0401766 | A1 * | 12/2022 | McIntosh | B64D 11/02 |

FOREIGN PATENT DOCUMENTS

| | | | |
|---|---|---|---|
| EP | 0850091 | B1 | 10/2001 |
| EP | 1299160 | B1 | 2/2005 |
| EP | 2623159 | A1 | 6/2018 |
| SU | 1400621 | A1 | 6/1988 |

* cited by examiner

NOZZLE CONFIGURATIONS TO CREATE A VORTEX OF FIRE SUPPRESSION AGENT

BACKGROUND

Exemplary embodiments pertain to the art of aircraft fire suppression and, in particular, to nozzle configurations to create a vortex of a fire suppression agent.

Smoke detection and fire suppression are important functions in many environments. In an aircraft, for example, the functions are critical. This is because, unlike in other environments where escape is possible, quick suppression of a fire is vital to the integrity of the aircraft and the safety of the passengers. Smoke detection systems monitor the cargo compartment. Once an overheat or fire condition is detected, a fire suppression agent is discharged. This suppression may be undertaken in two stages, an initial phase followed by a sustained phase.

BRIEF DESCRIPTION

In one embodiment, a fire suppression system in an aircraft includes a first nozzle within a region, the first nozzle performs discharge of a fire suppression agent in a first direction within a region. The system also includes a second nozzle within the region, the second nozzle performs discharge of the fire suppression agent in a second direction within the region. The discharge in the first direction by the first nozzle and the discharge in the second direction by the second nozzle generate and maintain a vortex of the fire suppression agent that occupies the region with rotational flow.

Additionally or alternatively, in this or other embodiments, the system also includes an additional nozzle within the region to perform discharge of the fire suppression agent in an additional direction.

Additionally or alternatively, in this or other embodiments, the discharge in the additional direction by the additional nozzle aligns with the flow direction of the vortex.

Additionally or alternatively, in this or other embodiments, the region is a cargo bay of the aircraft.

Additionally or alternatively, in this or other embodiments, the region is a portion of a cargo bay of the aircraft.

Additionally or alternatively, in this or other embodiments, the system also includes a third nozzle and a fourth nozzle within a second region that is a different portion of the cargo bay of the aircraft.

Additionally or alternatively, in this or other embodiments, the third nozzle performs discharge of the fire suppression agent in a third direction within the second region and the fourth nozzle performs discharge of the fire suppression agent in a fourth direction within the second region.

Additionally or alternatively, in this or other embodiments, the discharge in the third direction by the third nozzle and the discharge in the fourth direction by the fourth nozzle generate and maintain a second vortex of the fire suppression agent within the second region with a rotational flow direction that is opposite that of the first vortex.

Additionally or alternatively, in this or other embodiments, the system also includes two or more additional nozzles within one or more additional regions that are different portions of the cargo bay of the aircraft.

Additionally or alternatively, in this or other embodiments, the two or more additional nozzles are configured to perform discharge of the fire suppression agent in the one or more additional regions to generate one or more additional vortices that are additional to the vortex, each pair of adjacent vortices being generated to rotate in opposite directions.

In another embodiment, a method of assembling a fire suppression system in an aircraft includes disposing a first nozzle within a region and configuring the first nozzle to perform discharge of a fire suppression agent in a first direction within a region. The method also includes disposing a second nozzle within the region and configuring the second nozzle to perform discharge of the fire suppression agent in a second direction within the region. The discharge in the first direction by the first nozzle and the discharge in the second direction by the second nozzle generate and maintain a vortex of the fire suppression agent that occupies the region with rotational flow.

Additionally or alternatively, in this or other embodiments, the method also includes disposing an additional nozzle within the region and configuring the additional nozzle to perform discharge of the fire suppression agent in an additional direction.

Additionally or alternatively, in this or other embodiments, performing the discharge in the additional direction by the additional nozzle maintains the vortex based on the additional direction aligning with the flow direction of the vortex.

Additionally or alternatively, in this or other embodiments, the region is a cargo bay of the aircraft.

Additionally or alternatively, in this or other embodiments, the region is a portion of a cargo bay of the aircraft.

Additionally or alternatively, in this or other embodiments, the method also includes disposing a third nozzle and a fourth nozzle within a second region that is a different portion of the cargo bay of the aircraft.

Additionally or alternatively, in this or other embodiments, the method also includes configuring the third nozzle to perform discharge of the fire suppression agent in a third direction within the second region and configuring the fourth nozzle to perform discharge of the fire suppression agent in a fourth direction within the second region.

Additionally or alternatively, in this or other embodiments, performing the discharge in the third direction by the third nozzle and performing the discharge in the fourth direction by the fourth nozzle generates and maintains a second vortex of the fire suppression agent within the second region with a rotational flow direction that is opposite that of the first vortex.

Additionally or alternatively, in this or other embodiments, the method also includes disposing two or more additional nozzles within one or more additional regions that are different portions of the cargo bay of the aircraft.

Additionally or alternatively, in this or other embodiments, the method also includes configuring the two or more additional nozzles to perform discharge of the fire suppression agent in the one or more additional regions to generate one or more additional vortices that are additional to the vortex, each pair of adjacent vortices being generated to rotate in opposite directions.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

As previously noted, fire suppression is an important function in aircraft systems. In prior aircraft fire suppression systems, Halon 1301 is distributed into the cargo bay, for example, via a distribution system. Halon is an ozone-depleting substance whose production has ceased under the Montreal Protocol. Thus, environmentally friendly fire suppression agents are being developed as replacements for Halon.

Embodiments of the systems and methods detailed herein relate to nozzle configurations to create one or more vortices of a fire suppression agent. Recently, trifluoroiodomethane or trifluoromethyl iodide ($CF_3I$) has been considered as an efficient and environmentally friendly fire suppression agent. However, $CF_3I$, which is a low stability fire suppression agent as compared with Halon, for example, starts to break down at high temperatures (e.g., temperatures over 600° F.). According to exemplary embodiments, the flow rate of the fire suppression agent is increased. This generates turbulence within the discharge of the fire suppression agent. Additionally, nozzles that disperse the fire suppression agent are configured for directional emission rather than omnidirectional emission as before. Further, the nozzles are arranged such that two or more nozzles create a vortex (e.g., spiral vortex) of the fire suppression agent. Thus, the turbulence generated by the increased rate of discharge is channeled into a fluid flow with a vortex structure. This increases distribution and uniformity of the fire suppression agent and prolongs the time before the fire suppression agent breaks down.

As noted, the vortex created by the arrangement of the directional nozzles increases distribution and mixing of the fire suppression agent in the environment. The mixing, in turn, decreases the highest temperatures in the environment and causes more of the temperature within the environment to be closer to the average temperature. The temperature effect means that the low stability fire suppression agent will take longer to break down and, thus, will be more effective in suppressing the fire in the environment. An exemplary environment discussed for explanatory purposes is the cargo area of the aircraft.

Figure 1:
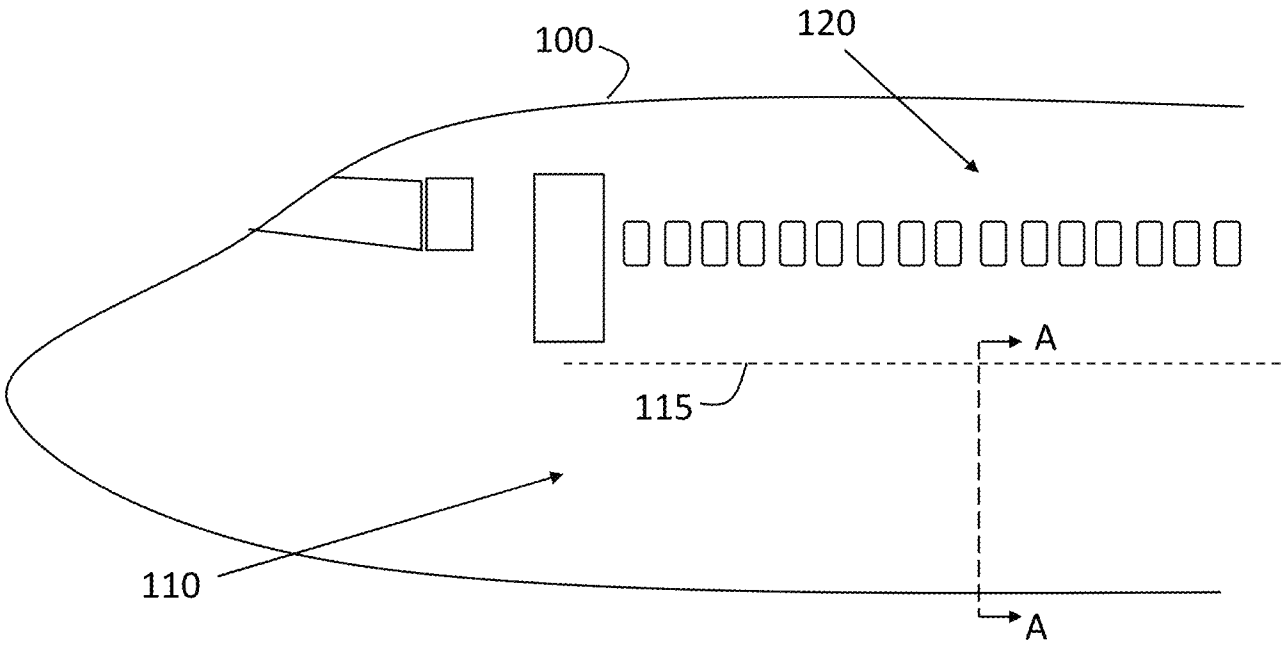
FIG. 1 illustrates aspects of an aircraft that includes exemplary nozzle configurations to create one or more vortices of a fire suppression agent according to one or more embodiments.

FIG. 1 illustrates aspects of an aircraft 100 that includes exemplary nozzle configurations 300, 400, 500, 600 (FIGS. 3-6) to create one or more vortices 310 (FIGS. 3-6) of a fire suppression agent according to one or more embodiments. The exemplary aircraft 100 includes a cargo compartment 110 and a passenger compartment 120, separated by a divider 115 that is generally indicated by the dashed line in FIG. 1. While the exemplary passenger compartment 120 is shown as one level, the passenger compartment 120 may include multiple levels according to alternate embodiments. Exemplary nozzle configurations 300, 400, 500, 600 are further detailed with reference to FIGS. 3-6. Fire suppression components are also generally present in other parts of the aircraft 100 (e.g., passenger compartment 120, engines, cockpit) but are not indicated. A cross-section indicated as A-A is shown in FIG. 2.

Figure 2:
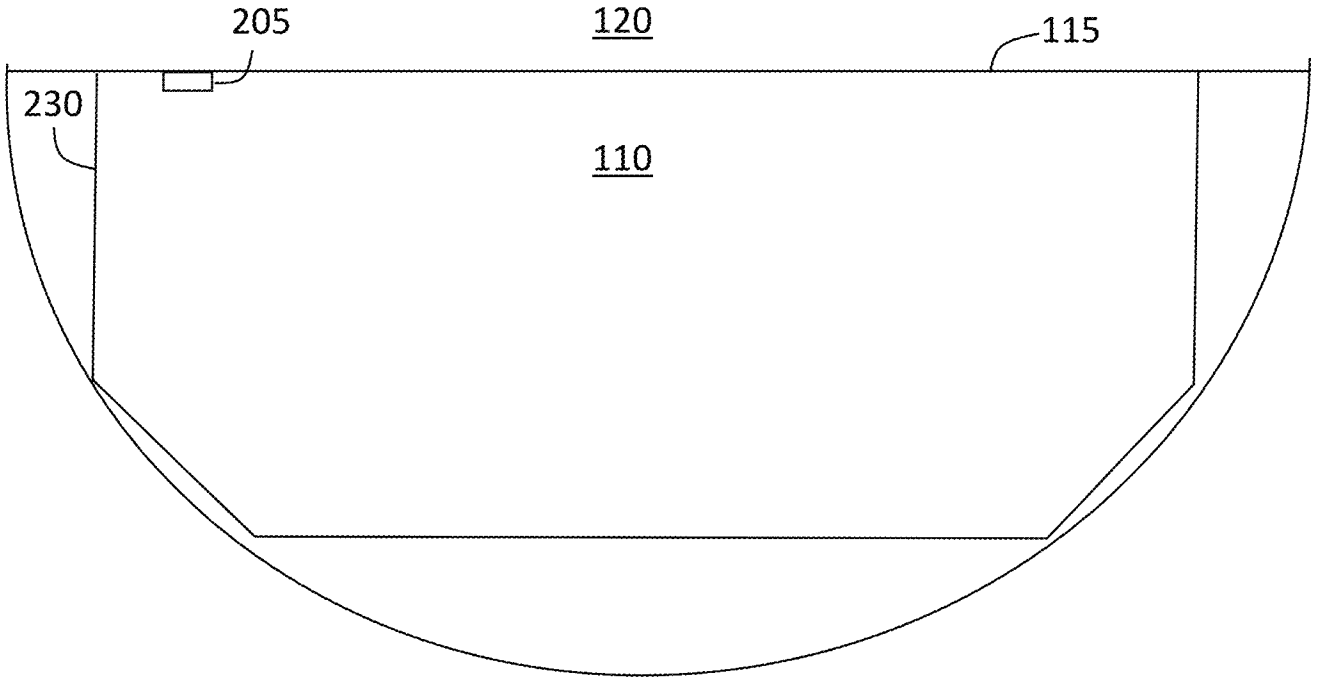
FIG. 2 is a cross-sectional view through A-A of the cargo compartment that includes exemplary nozzle configurations to create one or more vortices of a low stability fire suppression agent according to one or more embodiments.

FIG. 2 is a cross-sectional view through A-A of the cargo compartment 110 that includes exemplary nozzle configurations 300, 400, 500, 600 (FIGS. 3-6) to create one or more vortices 310 (FIGS. 3-6) of a low stability fire suppression agent according to one or more embodiments. The passenger compartment 120 is indicated above the cargo compartment 110. The two compartments 110, 120 are separated by the divider 115 that defines a ceiling of the cargo compartment 110 and a floor of the passenger compartment 120. An exemplary fire detection system 205 is shown at the ceiling level of the cargo compartment 110. As shown in FIGS. 3-6, nozzles 320 that discharge fire suppression agent may also be located at the ceiling level of the cargo compartment 110. According to alternate embodiments, the nozzles 320 may be located lower within the cargo compartment 110 instead.

FIGS. 3-6 illustrate different nozzle configurations 300, 400, 500, 600 to respectively create one or more vortices 310 according to exemplary embodiments. In each of FIGS. 3-6, the view is looking up at the divider 115 (i.e., the ceiling of the cargo compartment 110) from within the cargo compartment 110. As previously noted, although the nozzles 320 shown in FIGS. 3-6 are shown at the ceiling level for explanatory purposes, the nozzles 320 may instead be arranged lower in the cargo compartment 110 according to alternate embodiments. In addition, the flow rate used for discharge of fire suppression agent from each of the nozzles 320 may be increased as compared with typical discharge rates in aircraft applications in order to generate the vortices 310. For example, while the fire suppression agent may be fully dispersed in about a minute according to previous systems, the flow rate may be increased, according to one or more embodiments, to complete the discharge in about 10 seconds or in less than 30 seconds.

Figure 3:
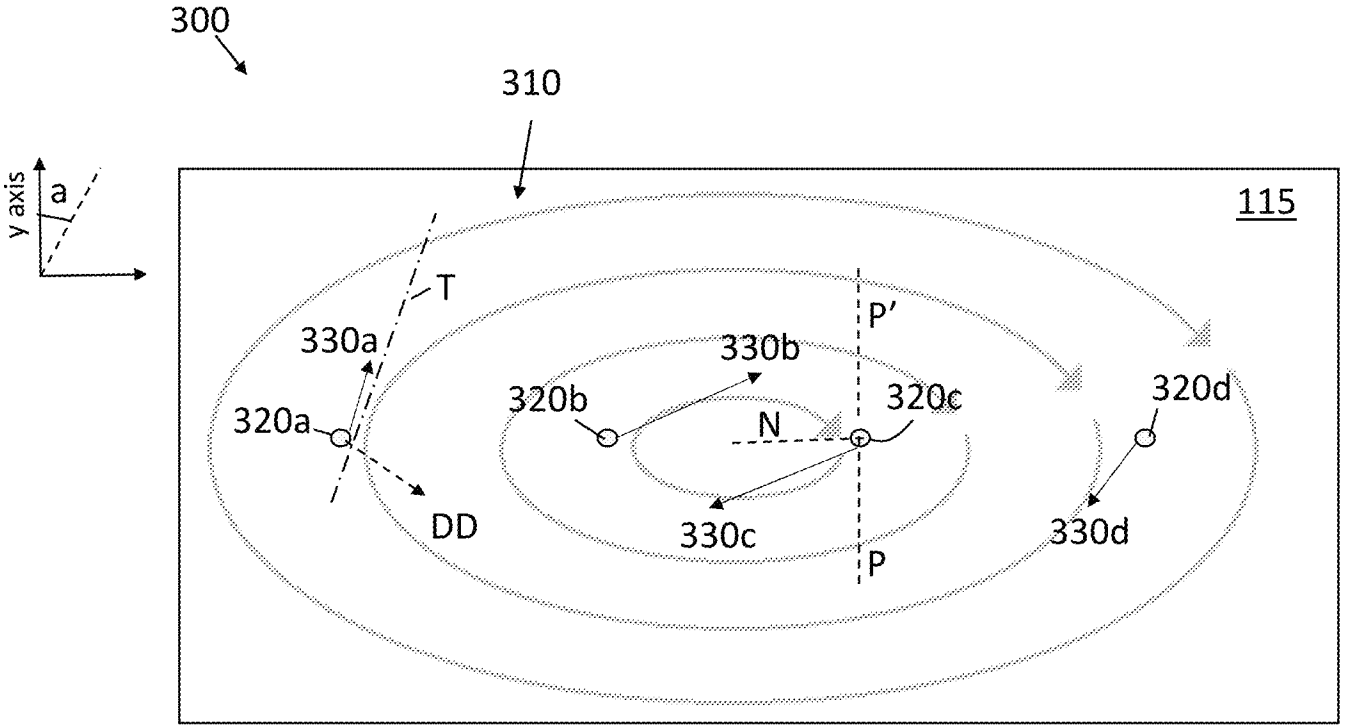
FIG. 3 shows an exemplary nozzle configuration to create an exemplary vortex of a low stability fire suppression agent according to one or more embodiments.

FIG. 3 shows an exemplary nozzle configuration 300 to create an exemplary vortex 310 of a low stability fire suppression agent according to one or more embodiments. An x axis and y axis are indicated for the purpose of discussing discharge angles, which are referenced to the y axis (e.g., exemplary indicated angle a is 30 degrees). Four nozzles 320*a*, 320*b*, 320*c*, 320*d* (generally referred to as 320) are shown to be arranged along a line (i.e., along the x axis at a same y value) across the center of the divider 115.

The directional discharge 330*a*, 330*b*, 330*c*, 330*d* (generally referred to as 330) of each of the nozzles 320 is indicated. The directional discharge of each nozzle 320 is selected to generate and maintain the vortex 310 of fire suppression agent. Exemplary angles of directional discharge 330 are 30 degrees for nozzle 320*a*, 60 degrees for nozzle 320*b*, 240 degrees for nozzle 320*c*, and 210 degrees for nozzle 320*d*. These exemplary angles ensure that directional discharge 330 from each of the nozzles 320 aligns with the vortex 310. If nozzle 320*a* emitted a directional discharge DD at 120 degrees, as indicated, this discharge (DD) would not contribute to the flow of the vortex 310 but, instead, would interfere with the flow of the vortex 310 and, thus, the uniform mixing and distribution facilitated by the vortex 310.

In general, according to one or more embodiments, the discharge from a given nozzle 320 should be between a normal line N to the center of the vortex 310 and a perpendicular line P that is perpendicular to that normal line N. This is shown for the nozzle 320*c* in FIG. 3. The normal line N is from the nozzle 320*c* to the center of the vortex 310, and the perpendicular line P is 90 degrees from the normal line N. As shown, the directional discharge 330*c* is between the normal line N and the perpendicular line P. The perpendicular line P originating at the nozzle 320*c* must be in the direction of flow of the vortex 310 (i.e., perpendicular line P rather than line P'). In other words, an optimal angle of the directional discharge 330 from a given nozzle 320 results in a spray that is aligned with the streamlines of the desired vortex 310. The range of acceptable angles can then be determined by comparing the angle of the spray with the angle of the streamlines of the vortex 310. That is, a line tangent to a point in the rotational flow of the vortex 310 (e.g., a point along the normal line N) and the directional discharge 330 (e.g., the center of a directional discharge 330 that covers a range of angles) must be aligned such that their dot product is positive. An exemplary tangent line T relevant to nozzle 320*b* is indicated in FIG. 3.

For explanatory purposes, a single directional discharge 330 is shown from each nozzle 320 at the above-noted angle. In alternate embodiments, each nozzle 320 may include more than one orifice and/or emit fire suppression agent over a range of spray angles (e.g., over 90 degrees in total). In addition, the exemplary angles noted above (or a range of angles of discharge) may be varied while still aligning the directional discharge 330 with the direction of rotation of the rotational flow of the vortex 310 or at least not interfering with the flow of the vortex 310. The amount of variation (in a single discharge angle or a range of angles of discharge from a given nozzle 320) that facilitates still aligning the directional discharge 330 with the flow of the vortex 310 may depend on the position of the nozzle 320. As noted above, in general, the discharge from a given nozzle 320 is limited to the 90 degrees between the normal line N to the center of the corresponding vortex 310 and the perpendicular line P to the normal line N.

For example, the above-noted angles of directional discharge 330 for nozzles 320*b* and 320*c* may be varied by ±10 degrees or the nozzles 320*b* and 320*c* may have a range of angles of directional discharge, centered at the above-noted angles and spanning a range of ±10 degrees while still aligning with the rotational flow of the vortex 310. The indicated angles of directional discharge 330 for the nozzles 320*a* and 320*d* may be varied by ±30 degrees or the nozzles 320*a* and 320*d* may have a range of angles of directional discharge, centered at the above-noted angles and spanning a range of ±30 degrees while still aligning with the flow of the vortex 310. The larger span or variation in the angles of directional discharge 330 by the nozzles 320*a*, 320*d* is based on the position of those nozzles 320*a*, 320*d* relative to the vortex 310.

In addition, one of the nozzles 320*b* or 320*c* may be eliminated while maintaining the vortex 310, although the energy of the vortex 310 may be decreased with fewer nozzles 320 providing directional discharge 330 that aligns with the rotational flow of the vortex 310. On the other hand, adding more nozzles 320 to the configuration 300 that are oriented to discharge fire suppression agent in a direction that aligns with the flow of the vortex 310 may add energy to the vortex 310. The numbers of nozzles 320 are not intended to be limited by the exemplary nozzle configuration 300.

In fluid dynamics, the vortex 310 is a region in a fluid (i.e., dispersed fire suppression agent) in which the flow revolves around an axis line (straight or curved) and forms a closed loop. Stated differently, the vortex 310 is a directional field of flow. As shown in FIG. 3, the vortex 310 spirals around the cargo bay 110. The vortex 310 is the largest field of flow in the space (i.e., cargo compartment 110) or subspace, as in the case of FIGS. 5 and 6. As discussed with reference to FIGS. 4-6, each of the exemplary nozzle configurations 400, 500, 600 is designed to generate and maintain the structure of the largest spiral vortex 310 within the space or subspace of the cargo bay 110.

Figure 4:
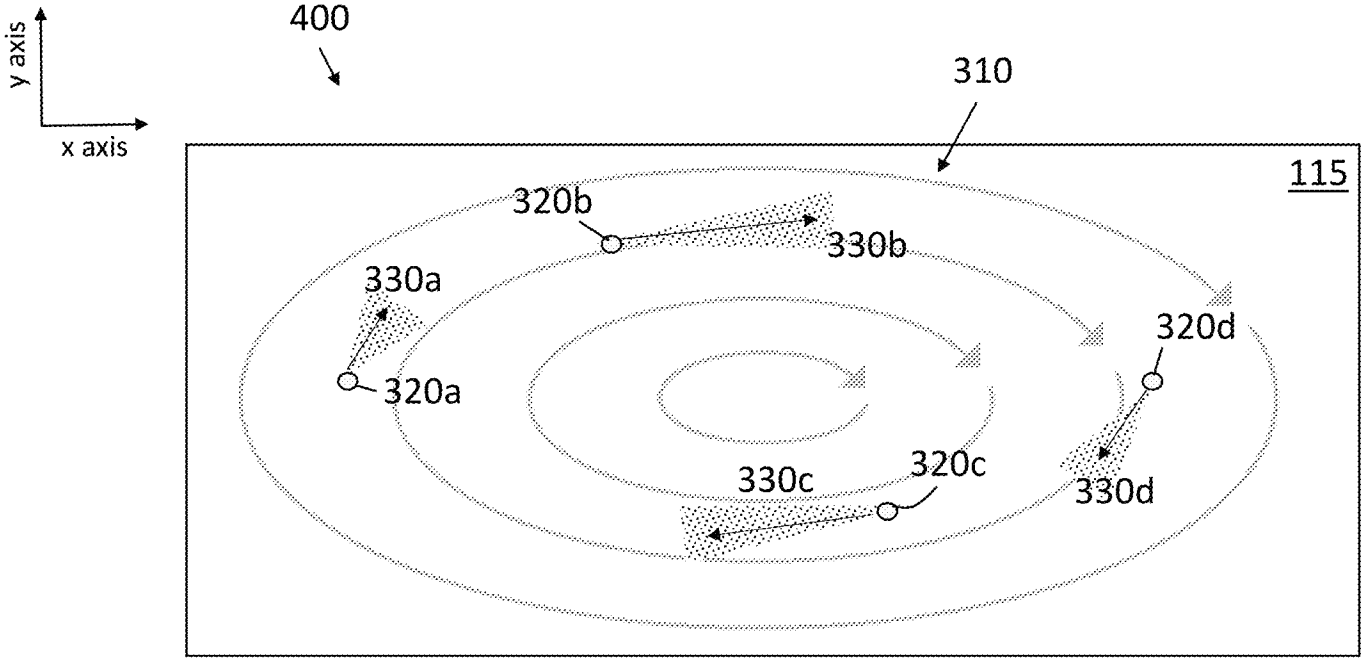
FIG. 4 shows another exemplary nozzle configuration to create an exemplary vortex of a low stability fire suppression agent according to one or more embodiments.

FIG. 4 shows an exemplary nozzle configuration 400 to create an exemplary vortex 310 of a low stability fire suppression agent according to one or more embodiments. While the positions of the nozzles 320*a*, 320*b*, 320*c*, 320*d* (generally referred to as 320) shown in FIG. 4 differ from the nozzle configuration 300 shown in FIG. 3, both nozzle configurations 300, 400 generate a similar vortex 310. That is, while the nozzles 320 in FIG. 3 are in a line, the nozzles 320 in FIG. 4 are arranged on the four sides of the separator 115. Specifically, the nozzles 320*b* and 320*c* are placed differently in FIG. 4 than in FIG. 3 while the nozzles 320*a* and 320*d* are in the same position in FIG. 4 as in FIG. 3.

As a result, the angles of the directional discharges 330*b*, 330*c* (generally referred to as 330) from the nozzles 320*b*, 320*c*, respectively, are different than those shown in FIG. 3 while the angles of the directional discharges 330*a*, 330*d* (generally referred to as 330) from the nozzles 320*a*, 320*d*, respectively, are the same as those shown in FIG. 3. Exemplary angles of directional discharge 330 are 30 degrees for nozzle 320*a*, 10 degrees for nozzle 320*b*, 260 degrees for nozzle 320*c*, and 210 degrees for nozzle 320*d*. As noted for the exemplary nozzle configuration 300 shown in FIG. 3, these angles may span a range or be varied while still aligning the directional discharge 330 with the flow of the vortex 310. In the embodiment shown in FIG. 4, a directional discharge 330 over a range of angles is shown and the angle at the center of the range is indicated above. As show in FIG. 4, the range of angles for the directional discharge 330 by the nozzles 320*a*, 320*d* is greater than the range of angles for the directional discharge 330 by the nozzles 320*b*, 320*c* due to their position relative to the vortex 310.

Figure 5:
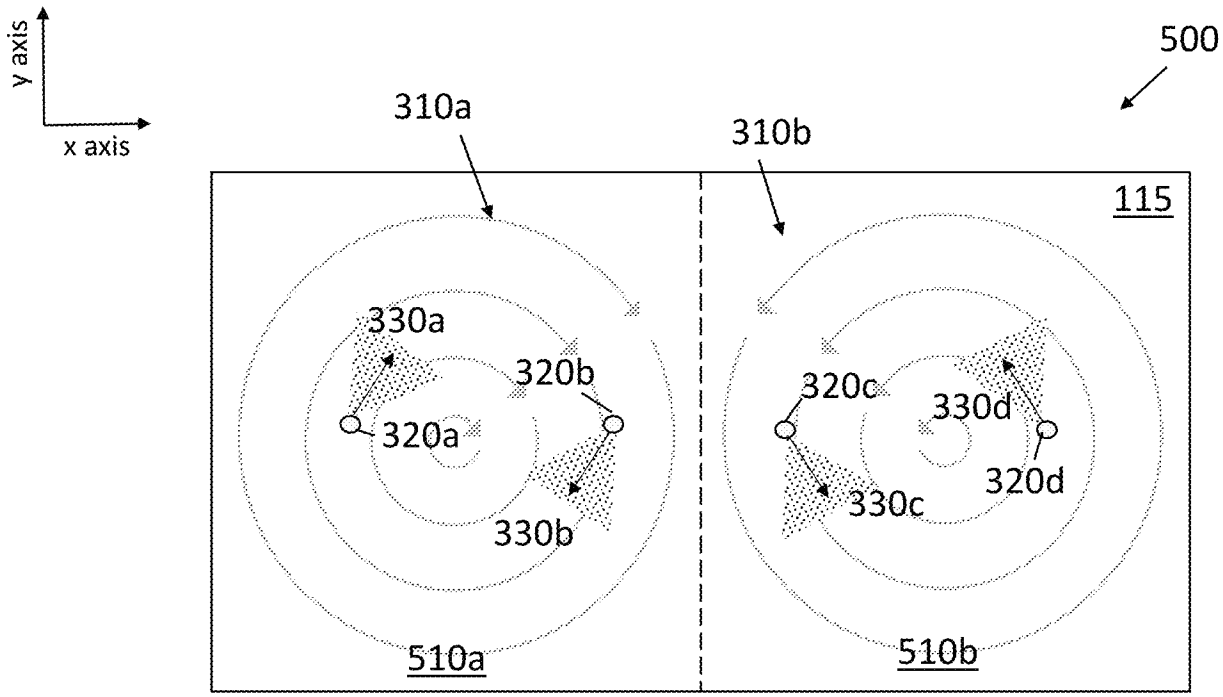
FIG. 5 shows an exemplary nozzle configuration to create two exemplary vortices of a low stability fire suppression agent according to one or more embodiments.

FIG. 5 shows an exemplary nozzle configuration 500 to create an exemplary vortices 310*a*, 310*b* (generally referred to as 310) of a fire suppression agent according to one or more embodiments. The space, which is the cargo compartment 110 in the exemplary case, is divided into two regions 510*a*, 510*b* (indicated by the dashed line) in the example shown in FIG. 5. In FIGS. 3 and 4, the single region is the cargo compartment 110 itself. Nozzles 320*a* and 320*b* are in the first region 510*a* and generate vortex 310*a* with their respective directional discharges 330*a*, 330*b* of fire suppression agent. Nozzles 320*c* and 320*d* are in the second region 510*b* and generate vortex 310*b* with their respective directional discharges 330*c*, 330*d* of fire suppression agent. The direction of flow (i.e., direction of rotation of rotational flows) of the vortices 310*a*, 310*b* must be generated such that the two adjacent vortices 310*a*, 310*b* rotate in opposite directions in order to prevent them from merging. As indicated in FIG. 5, the nozzles 320*a*, 320*b* are arranged and configured to provide directional discharges 330*a*, 330*b* that align with the desired vortex 310*a* while the nozzles 320*c*, 320*d* are arranged and configured to provide directional discharges 330*c*, 330*d* that align with the desired vortex 310*b*.

Figure 6:
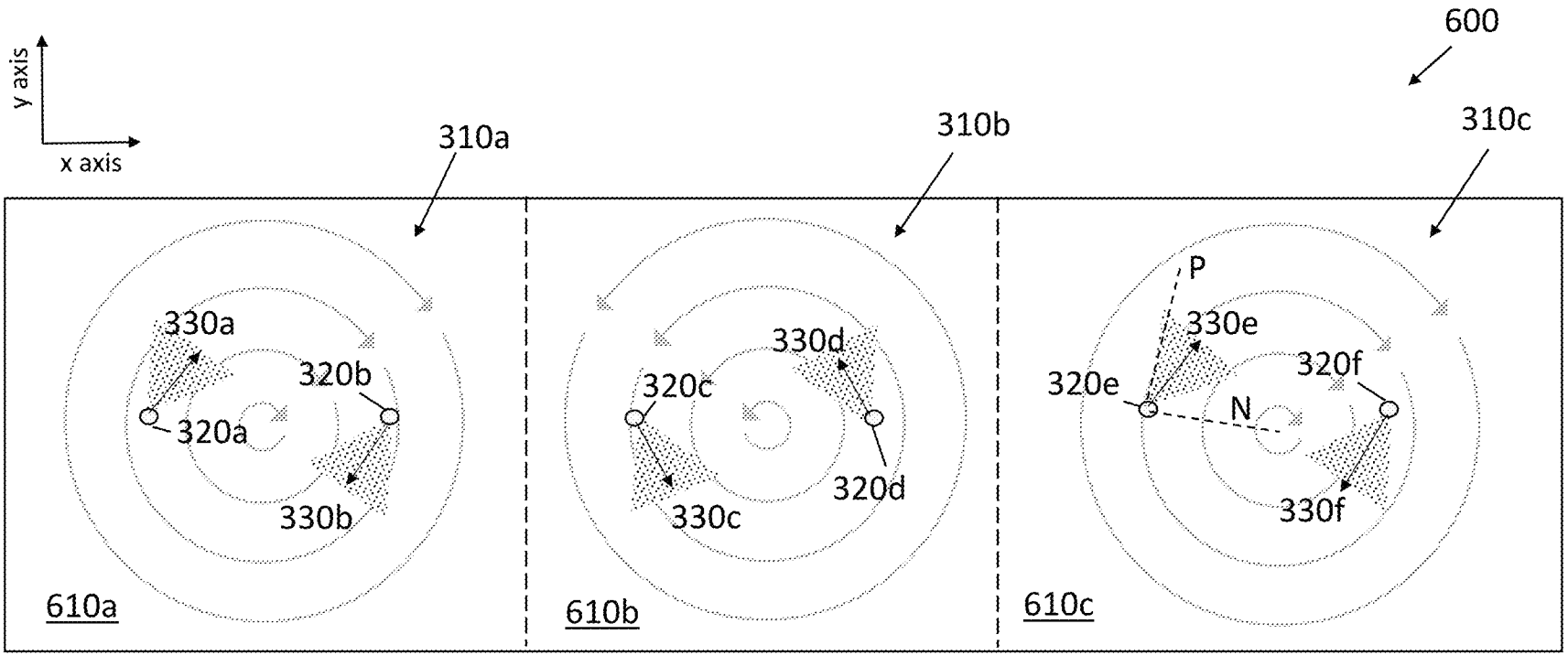
FIG. 6 shows an exemplary nozzle configuration to create three exemplary vortices of a low stability fire suppression agent according to one or more embodiments.

FIG. 6 shows an exemplary nozzle configuration 600 to create exemplary vortices 310*a*, 310*b*, 310*c* (generally referred to as 310) of a fire suppression agent according to one or more embodiments. The space, which is the cargo compartment 110 in the exemplary case, is divided into three regions 610*a*, 610*b*, 610*c* (indicated by the dashed lines) in the example shown in FIG. 6. Nozzles 320*a* and 320*b* are in the first region 610*a* and generate vortex 310*a* with their respective directional discharges 330*a*, 330*b* of fire suppression agent. Nozzles 320*c* and 320*d* are in the second region 610*b* and generate vortex 310*b* with their respective directional discharges 330*c*, 330*d* of fire suppression agent. Nozzles 320*e* and 320*f* are in the third region 610*c* and generate vortex 310*c* with their respective directional discharges 330*e*, 330*f* of fire suppression agent. The normal line N and the perpendicular line P to the normal line N in the direction of flow of the vortex 310*c* are indicated for nozzle 320*e*. As discussed with reference to FIG. 3, the directional discharge 330*e* from nozzle 320*e* should be between the 90 degrees defined by the normal line N and the perpendicular line P in order to generate and maintain the vortex 310*c*.

As noted with reference to FIG. 5, adjacent vortices 310 must flow in opposite directions to keep from merging. Thus, the two outer vortices 310*a*, 310*c* flow clockwise while the center vortex 310*b*, which is adjacent to both vortices 310*a*, 310*c*, flows counter-clockwise. As indicated in FIG. 6, the nozzles 320*a*, 320*b* are arranged and configured to provide directional discharges 330*a*, 330*b* that align with the desired vortex 310*a*, the nozzles 320*c*, 320*d* are arranged and configured to provide directional discharges 330*c*, 330*d* that align with the desired vortex 310*b*, and the nozzles 320*e*, 320*f* are arranged and configured to provide directional discharges 330*e*, 330*f* that align with the desired vortex 310*c*.

Figure 7:
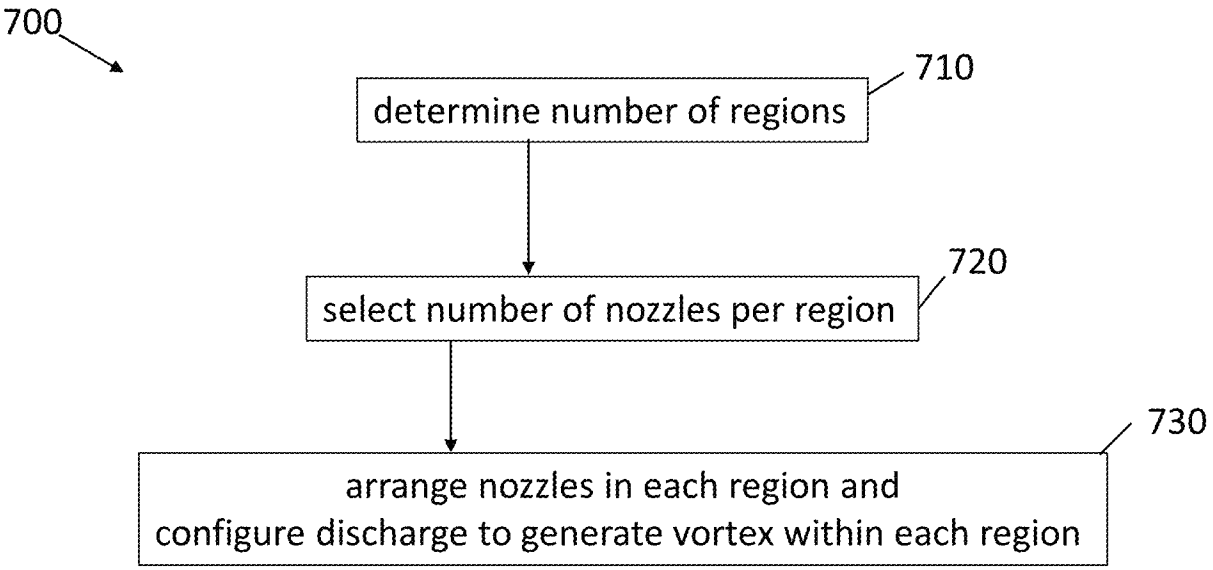
FIG. 7 is a process flow of a method of assembling a nozzle configuration to create one or more vortices of low stability fire suppression agent according to one or more embodiments.

FIG. 7 is a process flow of a method 700 of arranging nozzles 320 to create one or more vortices 310 as part of a fire suppression system according to one or more embodiments. The exemplary space for placement of the fire suppression system is the cargo bay 110 of an aircraft 100. At block 710, determining the number of regions refers to determining if the cargo bay 110 should be treated as a single region as shown in FIGS. 3 and 4 or subdivided into regions 510, 610 as shown in FIGS. 5 and 6. This determination may be based on the size or aspect ratio of the cargo bay 110. According to exemplary embodiments, the selection of the number of nozzles 320 per region, at block 720, and, more particularly, a limit on the total number of nozzles 320 may additional be used to determine the number of regions. For example, for the same size of cargo bay 110, being limited to three or four nozzles 320 precludes subdivision into three regions as shown in FIG. 6, for example. Computational fluid dynamic modeling may be used to select the number of regions (at block 710) and the number of nozzles per region (at block 720) to maximize distribution and mixing of fire suppression agent.

At block 730, arranging the nozzles 320 in each region and configuring the discharge 330 to generate a vortex 310 within each region refers to the range and variation in angles of the directional discharge 330 from each nozzle 320 as well as the direction in which adjacent vortices 310 are generated. As previously noted, the directional discharge of each nozzle 320 is configured to be aligned with the vortex 310 that is helps to generate and maintain. This alignment means that the directional discharge is between a normal line N from a given nozzle 320 to the center of the vortex 310 being generated and maintained by the nozzle 320 and a perpendicular line P to the normal line N. The alignment may also be considered based on a tangent line T to a point in the rotational flow of the vortex 310. Adjacent vortices 310 are generated to flow in opposite directions to maintain the separate vortices 310.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A fire suppression system in an aircraft that includes a plurality of adjacent regions, wherein in each region of the plurality of regions, the system comprises:

a plurality of nozzles disposed within the region, including:

a first nozzle within the region, the first nozzle being configured to perform discharge of a fire suppression agent in a first direction within the region; and a second nozzle within the region, the second nozzle being configured to perform discharge of the fire suppression agent in a second direction within the region, wherein:

the discharge in the first direction by the first nozzle and the discharge in the second direction by the second nozzle generate and maintain a vortex of the fire suppression agent that occupies the region with rotational flow; and within the region, the discharge from each nozzle of the plurality of nozzles is between a normal line to the center of the vortex in the region and a perpendicular line that is perpendicular to the normal line, wherein the vortices in adjacent ones of the regions are generated to rotate in opposite directions.

2. The system according to claim 1, further comprising an additional nozzle within the region configured to perform discharge of the fire suppression agent in an additional direction.

3. The system according to claim 2, wherein the discharge in the additional direction by the additional nozzle aligns with a flow direction of the vortex.

4. The system according to claim 1, wherein the regions are within a cargo bay of the aircraft.

5. The system according to claim 1, wherein the regions are within a portion of a cargo bay of the aircraft.

6. The system according to claim 5, further comprising a third nozzle and a fourth nozzle within a second region that is a different portion of the cargo bay of the aircraft.

7. The system according to claim 6, wherein the third nozzle is configured to perform discharge of the fire suppression agent in a third direction within the second region of the regions and the fourth nozzle is configured to perform discharge of the fire suppression agent in a fourth direction within the second region.

8. The system according to claim 7, wherein the discharge in the third direction by the third nozzle and the discharge in the fourth direction by the fourth nozzle generate and maintain a second vortex of the fire suppression agent within the second region with a rotational flow direction that is opposite that of the first vortex.

9. The system according to claim 5, further comprising two or more additional nozzles within one or more additional regions of the regions that are different portions of the cargo bay of the aircraft.

10. The system according to claim 9, wherein the two or more additional nozzles are configured to perform discharge of the fire suppression agent in the one or more additional regions to generate one or more additional vortices that are additional to the vortex, each of the vortices in adjacent ones of the regions being generated to rotate in opposite directions.

11. A method of assembling a fire suppression system in an aircraft that includes a plurality of adjacent regions, wherein within each region of the plurality of regions, the method comprises:

disposing a plurality of nozzles within the region, including:

disposing a first nozzle within the region and configuring the first nozzle to perform discharge of a fire suppression agent in a first direction within the region; and disposing a second nozzle within the region and configuring the second nozzle to perform discharge of the fire suppression agent in a second direction within the region, wherein:

the discharge in the first direction by the first nozzle and the discharge in the second direction by the second nozzle generate and maintain a vortex of the fire suppression agent that occupies the region with rotational flow; and within the region, the discharge from each nozzle is between a normal line to the center of the vortex in the region and a perpendicular line that is perpendicular to the normal line, wherein the vortices in adjacent ones of the regions are generated to rotate in opposite directions.

12. The method according to claim 11, further comprising disposing an additional nozzle within the region and configuring the additional nozzle to perform discharge of the fire suppression agent in an additional direction.

13. The method according to claim 12, wherein performing the discharge in the additional direction by the additional nozzle maintains the vortex based on the additional direction aligning with a flow direction of the vortex.

14. The method according to claim 11, wherein the regions are within a cargo bay of the aircraft.

15. The method according to claim 11, wherein the regions are within a portion of a cargo bay of the aircraft.

16. The method according to claim 15, further comprising disposing a third nozzle and a fourth nozzle within a second region that is a different portion of the cargo bay of the aircraft.

17. The method according to claim 16, further comprising configuring the third nozzle to perform discharge of the fire suppression agent in a third direction within the second region of the regions and configuring the fourth nozzle to perform discharge of the fire suppression agent in a fourth direction within the second region.

18. The method according to claim 17, wherein performing the discharge in the third direction by the third nozzle and performing the discharge in the fourth direction by the fourth nozzle generates and maintains a second vortex of the fire suppression agent within the second region with a rotational flow direction that is opposite that of the first vortex.

19. The method according to claim 15, further comprising disposing two or more additional nozzles within one or more additional regions of the regions that are different portions of the cargo bay of the aircraft.

20. The method according to claim 19, further comprising configuring the two or more additional nozzles to perform discharge of the fire suppression agent in the one or more additional regions to generate one or more additional vortices that are additional to the vortex, each of the vortices in adjacent ones of the regions being generated to rotate in opposite directions.

* * * * *